United States Patent [19]

Jarosz et al.

[11] 4,359,708

[45] Nov. 16, 1982

[54] FUSIBLE ELEMENT FOR A CURRENT-LIMITING FUSE HAVING GROUPS OF SPACED HOLES OR NOTCHES THEREIN

[75] Inventors: John M. Jarosz, Skokie; William R. Panas, Glenview, both of Ill.

[73] Assignee: S&C Electric Company, Chicago, Ill.

[21] Appl. No.: 194,712

[22] Filed: Oct. 6, 1980

[51] Int. Cl.[3] ..... H01H 55/10

[52] U.S. Cl. ..... 337/159; 337/295

[58] Field of Search ..... 337/158–162, 337/276, 290, 292, 295

[56] References Cited

U.S. PATENT DOCUMENTS 4,123,738 10/1978 Huber ..... 337/159

4,204,183 5/1980 Blewitt ..... 337/159

FOREIGN PATENT DOCUMENTS 876884 7/1971 Canada ..... 337/161

1193154 5/1965 Fed. Rep. of Germany ..... 337/295

*Primary Examiner*—William H. Beha, Jr.

*Attorney, Agent, or Firm*—John D. Kaufmann

[57] ABSTRACT

A fusible element of a current-limiting fuse has a plurality of hole groups with at least two holes in each group. Separation between adjacent holes within the group is substantially less than separation between adjacent groups. Accordingly, while fault currents driven by voltages at two different levels are effectively extinguished, the back voltage developed by the fuse during interruption of a fault current driven by the lower voltage is prevented from exceeding a selected value.

21 Claims, 8 Drawing Figures

12
52
60
50
54
56
58

66
64
62

68

FUSIBLE ELEMENT FOR A CURRENT-LIMITING FUSE HAVING GROUPS OF SPACED HOLES OR NOTCHES THEREIN

BACKGROUND OF THE INVENTION

1. Field of the Invention

The present invention relates to an improved fusible element for a current-limiting fuse and, more particularly, to an improved fusible element for a current-limiting fuse usable to protect high-voltage circuits against faults occurring at both higher phase-to-phase voltages and lower phase-to-ground voltages. More specifically, the present invention relates to an improved fusible element for a current-limiting fuse capable of effectively interrupting fault currents at both voltages without exceeding a predetermined back voltage while interrupting faults at the lower voltage.

2. Prior Art

Current-limiting fuses are, in general, well known. Such a fuse serves two functions. First, and in common with all fuses, a current-limiting fuse responds to fault currents or other over-currents in a circuit by interrupting the current to protect the circuit. Such response is due to the inclusion in the fuse of a fusible element made of a material which melts, fuses, vaporizes or otherwise becomes disintegral when the $I^2t$ heating effect of the fault current therein exceeds some predetermined value. Second, unlike other types of fuses—power fuses and cutouts, for example—a current-limiting fuse limits the magnitude of the fault current to some maximum value while interrupting it.

The most common type of current-limiting fuse is the so-called silver-sand fuse. In such a fuse, the fusible element is intimately surrounded by a compacted fulgurite-forming medium, such as silica or quartz sand. A fulgurite is a silicon substance formed by the fusing or vitrification of the sand due to its absorption of high energy such as that accompanying lightning or an electric arc. The fusible element is a ribbon-like length of a fusible metal, such as elemental silver or copper, which may be straight or curvilinearly wound, for example, in a helical or spiral configuration, within an insulative housing for the sand. Typically, such a fusible element contains a plurality of holes or notches formed therethrough or therein which, in effect, decrease the cross-section of the element at their points of formation. See U.S. Pat. Nos. 4,204,184 and 4,204,183.

For purposes of explaining the present invention, it is assumed that a current-limiting fuse of the prior art is connected to a circuit which comprises a power source in series with the fusible element which is, in turn, upstream of loads powered by the source. The circuit may be one phase of a three-phase system, each phase of which includes a similar fuse. The circuit may be viewed as also containing a single series inductance representative of all the inductance thereof "lumped" together. The fusible element of the fuse is selected so that if the current driven through the electrical series by the source is "normal," that is, below a selected level, the heating effect of the square of the current ($I^2t$) is insufficient to melt, fuse or vaporize the fusible element at any of the holes or notches where its cross-section is decreased by the holes or notches. During the time normal current flows, there is a small, nearly zero, voltage drop across the fuse. If, for any reason, the current in the circuit becomes a fault current, that is, exceeds the selected level for a sufficient time, $I^2t$ is sufficient to melt, fuse or vaporize the fusible element across the width thereof on either side of the points of formation of the holes or notches. At each now melted location, which is defined by a pair of sites or fronts widthwise of the fusible element and separated along the length thereof, a gap is produced. An arc is established in each gap with its ends terminating on the separated sites or fronts, defining its respective gap. Each arc generates an arc voltage or back voltage opposed in polarity to the source voltage, the total arc voltage of the fuse being the cumulative or additive effect of all the arcs so formed. Thus, if the fusible element has one hole or notch therein, an initial arc or back voltage $V_a$ is generated; if the fusible element has four similar holes or notches therein, an initial arc or back voltage $4V_a$ is generated; if the fusible element has N similar holes or notches, an initial arc or back voltage $NV_a$ is generated. Typically, the initial arc or back voltage of the fuse "jumps" or rises in a very short time from the small, nearly zero, voltage drop across the fuse to a substantial value which is initially somewhat less than the source voltage. This jump or rise in the fuse's arc voltage or back voltage occurs immediately after the arc or arcs form.

Each arc is both constricted and cooled by the sand, and both effects of the sand further elevate the arc or back voltage of the fuse. Constriction is the result of "forcing" each arc to traverse a path confined by compacted grains of the sand which reside in and about each gap between the sites or fronts. Cooling of the arcs, which is due to "heat-sink" effect of the sand, absorbs energy therefrom forming the fulgurite.

Following their initial formation, the arcs "burn back" or melt away the element in opposite directions away from the former location of the holes or notches. The ends of each arc and the respective opposed sites or fronts on which they terminate, constantly "move" away or recede from each other as each arc burns back the element to widen the gap in which it is formed. The "movement" of the sites or fronts away from each other elongates the arcs and exposes each arc to "fresh" or "new" sand. The "fresh" or "new" sand further constricts and further cools the elongating arcs. Thus, as long as the arcs persist—which condition obtains as long as current is present in the electrical series—they both continually elongate and have their elongating length further constricted and cooled. This results in yet further elevation of the arc or back voltage with time. In sum, then, the arc or back voltage generated by the fuse depends on both the number of arcs formed and the amount of burn-back of the element by these arcs. The rate of burn-back is, in turn, related to the level of current in the fusible element.

Shortly after the initial jump in arc or back voltage, which is followed by the continuing increase therein with time due to burn-back, the circuit current begins to "turn down" or be forced to continuously decreasing levels. As the current turns down, the arc voltage continues to increase, albeit at a slower rate, as the arcs continue to burn back the fusible element. The continuing arc voltage causes the current to continuously decrease. Assuming there to have been a sufficiently long fusible element with sufficient distance between the holes or notches, this process continues until the current is turned down to zero. At zero current, the circuit is interrupted if the dielectric strength of the gaps is sufficiently high. The turn down in current shortly after the arc or back voltage begins to increase results in the fuse acting in a current-limiting or energy-limiting manner. That is, during the operation of the fuse, the circuit current assumes a lower value—its value just prior to turn-down—than it otherwise would, thus protecting the circuit and devices connected thereto from excessive over-currents.

During the operation of a current-limiting fuse, arc or back voltages in excess of the source voltage are generated. Indeed, it is necessary that the fuse's arc or back voltage exceed the source voltage for current limitation to occur. If the fusible element is very long, current interruption may be very effective although very high arc or back voltages will be generated. As a result, typical current-limiting fuses include elements of reasonable lengths, that is, lengths selected so that the elements are nearly totally burned back or nearly consumed at a time when the turn-down in current is sufficient to assure that current zero will be reached. Should the fusible element be consumed, all the arcs merge into a single long arc, the arc or back voltage of which cannot further increase because no "fresh" or "new" sand can be introduced into the gaps. In typical fusible elements, the holes or notches are evenly spaced so that the fusible element is burned back the same amount between each hole or notch. The number of arcs is equal to the number of holes or notches and the number of receding sites or fronts at which burn-back occurs is twice the number of holes. Thus, while typical current-limiting fuses operate, the arc or back voltage thereof is simply equal to the product of the number of holes or notches multiplied by the arc or back voltage of any one of the arcs. The arc or back voltage of the fuse increases as long as burn-back occurs and the rate of the arc or back voltage increase is equal to the product of the number of holes or notches multiplied by the rate of arc or back voltage increase of any one of the arcs.

In many circuits, faults may occur at a lower or a higher voltage. In a 15 kv (phase-to-phase voltage) three-phase circuit, for example, phase-to-phase fault currents are, in effect, driven by a 15 kv source voltage while phase-to-ground fault currents are driven by a 9 kv (phase-to-ground voltage) source voltage. If current interruption is the sole desideratum, a single fusible element can be chosen which will ensure interruption of fault currents at both voltages. Typically, the fuse in each phase can be selected so that it is, by itself, capable of interrupting phase-to-ground fault currents which occur only in its phase and which are not "seen" by the other phases or the fuses therein. Care must be used, however, in selecting fusible elements which will not cause the operation of surge arrestors connected between each phase and ground. If the selected fusible element is too long or for any other reason generates an arc or back voltage which is too high, the arc or back voltage of the fuse will ultimately exceed the surge arrestor voltage and cause sparkover thereof. 15 kv (phase-to-ground voltage) arrestors will typically spark over at about 25–27 kv. Thus, when the fuse interrupts phase-to-ground fault currents driven by a 9 kv source voltage, it is desirable that the arc or back voltage of the fuse not exceed 25–27 kv.

Even though each fuse by itself might not be capable of interrupting fault currents driven by the higher (15 kv) phase-to-phase voltage, such faults necessarily involve the fuses of the faulted phases in electrical series. Accordingly, the fuses are selected so as to be able, in a series combination, to interrupt the fault current by together generating a sufficiently high arc or back voltage.

From what has been said above, in typical current-limiting fuses the fusible element itself is the current-responsive "trigger" for the fuse. When current gets sufficiently high, the $I^2t$ effect thereof directly initiates melting of the fusible element followed by current-interrupting operation of the fuse. This is true even in a phase-to-phase fault current situation where one fuse may operate before the second fuse, due, for example, to normal manufacturing tolerances. Specifically, although one fuse may operate first and generate an arc or back voltage preventing the fault current from further increasing, the second fuse will, nevertheless, eventually operate because the element thereof responds to $I^2t$, not to I. That is, although $I^2$ cannot increase, the product of $I^2$ and t will initiate operation of the second fuse when t is sufficiently large.

In a variant type of current-limiting fuse, a silver-sand fuse is shunted by a normally closed high current-capacity switch. See commonly-assigned U.S. patent applications, Ser. No. 21,646, filed Mar. 19, 1979 and Ser. No. 972,650, filed Dec. 21, 1978 (the latter application being now abandoned), both in the name of Meister, Ser. No. 188,660, filed Sept. 19, 1980 in the name of Tobin, Ser. No. 179,367, filed Aug. 18, 1980 in the names of Jarosz and Panas, and Ser. No. 179,336, filed Aug. 18, 1980 in the name of O'Leary. Because the switch has a high current-carrying ability, this arrangement permits the combination to have a high continuous-current-carrying ability, which silver-sand fuses alone do not have. The switch is opened by a current-sensor when the current reaches a value in excess of a selected level. Thus, the sensor responds to I, not to $I^2t$. When the switch opens, the current is entirely commutated to the fuse which begins to operate. As the fuse begins to operate, the fault current begins to decrease as described above, whether the fault current is phase-to-phase or phase-to-ground. If, due to tolerance differences between the sensors of the fuses in two phases between which a fault current flows, only one sensor initially responds, the second sensor will not later respond because the fault current level is decreasing. Thus, only one fuse may be available to interrupt phase-to-phase fault currents. Accordingly, each variant type of fuse must be capable of itself interrupting fault currents at the higher phase-to-phase voltage, assumed above to be 15 kv. As noted above, this can easily be achieved by appropriate selecting of a fusible element. A problem arises, however, at lower voltage phase-to-ground fault currents where too long an element—that is, an element sufficiently long to interrupt phase-to-phase fault currents—is present.

Specifically, phase-to-ground fault currents commutated to the fuse by the opening of the switch cause the fusible element to melt at the holes or notches, as do the higher voltage phase-to-ground fault currents, and initiate burn-back of the fusible element at each site or front pair at either end of each arc. This action, as described above, effects the generation of the arc or back voltage. It has been found, however, that the arc voltage generated by a silver-sand current-limiting fuse, which by itself is capable of interrupting phase-to-phase fault currents, may well exceed the spark-over voltage of the phase-to-ground surge arrestors while interrupting phase-to-ground fault currents. Sparkover of the surge arrestors under the conditions described in undesirable, for arrestors are intended to protect the circuit in the event of surges such as those caused by lightning, and not by surges caused by current interruption by the fuses.

Accordingly, a general object of the present invention is the provision of a fusible element for a current-limiting fuse which effectively interrupts fault currents driven by both higher phase-to-phase voltages and lower phase-to-ground voltages, while limiting the arc voltage generated by the fuse during the interruption of fault currents at the lower voltage.

SUMMARY OF THE INVENTION

With the above and other objects in view, the present invention contemplates an improved fusible element for a current-limiting fuse. The element comprises a conductive ribbon. A plurality of holes or notches are formed through or in the ribbon. The holes or notches are formed in a plurality of predetermined patterns along the length of the ribbon. Each pattern comprises plural groups of holes or notches, the holes or notches of each group being spaced apart within the group by a small distance. Each group is spaced from adjacent groups by a distance substantially greater than the distance between the holes or notches within each group. Faults occurring at higher phase-to-phase voltages melt the ribbon first at the reduced cross-sectional points thereof—that is, those locations where the holes or notches have been formed—and then burn back the ribbon between the groups until current interruption is effected. Lower phase-to-ground voltage fault currents first melt the ribbon at the hole locations, just as do the higher voltage fault currents. Because the distance between the holes within the groups is small, the numerous arcs formed first burn back the ribbon along the shorter distance between the holes and then the arcs of each group merge into a single arc. The ribbon is thereafter burned back between the groups by the merged arcs at a more gradual total rate than occurred before the merger or than is the case with ribbons having longer distances between adjacent, evenly spaced holes. In effect, the pattern decreases the amount of the ribbon available for burn-back after arc merger, thus preventing the back voltage of the fuse from exceeding a selected value, such as the sparkover value of arc arrestors.

In preferred embodiments, the ribbon is made of copper, but other metals such as elemental silver may be used. In preferred specific embodiments, each group has 2, 3 or 4 holes or notches, the distance between the adjacent holes or notches in each group being about 0.470 inch and the distance between adjacent groups being about 1.125 or 1.00 inch.

DETAILED DESCRIPTION

Figure 1:
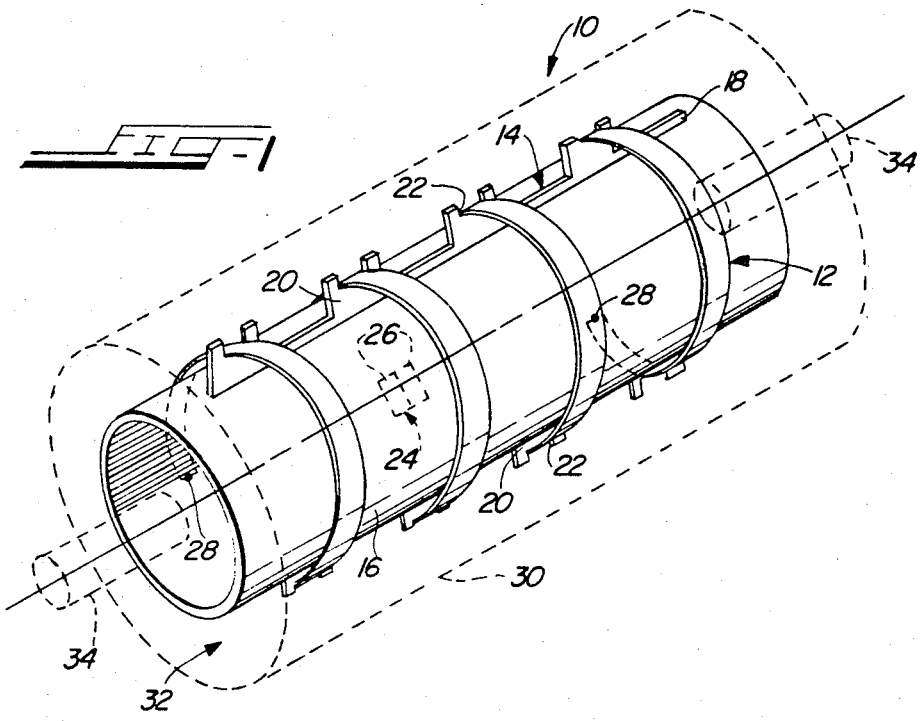
FIG. 1 is a generalized, perspective view of a portion of a current-limiting fuse which includes a fusible element according to the principles of the present invention.

Referring first to FIG. 1, there is shown a current-limiting fuse 10 which includes a fusible element 12 according to the present invention. Various portions of the fuse 10 are shown only generally, and some portions thereof are shown only in phantom for the sake of clarity.

The fuse 10 includes the fusible element 12 held in a circular, helical configuration by an element support 14, more fully described in a commonly-assigned application, Ser. No. 181,603, filed Aug. 27, 1980 in the names of John Jarosz and William Panas. The support includes a hollow, cylindrical, insulative cylinder 16 to which are attached in diametric opposition a pair of fins 18. The fins 18 include a series of projections 20 and are attached to the cylinder 16 so that the projections are offset along the cylinder 16. The projections 20 include trapezoidal notches 22 into which the fusible element is wound and snapped and which hold the element 12 in the circular, helical configuration depicted. As described below, the fusible element 12 has its cross-section decreased in selected locations in a manner not depicted in FIG. 1.

The cylinder 16 may house a normally closed switch only generally shown at 24 which may include a pair of contacts 26 movable apart along a fixed line of direction within the cylinder 16. The ends 28 of the fusible element 12 are electrically connected in shunt with the contacts 26 by conductors (not shown). Current normally flows through the switch 24 which shunts all or a majority thereof away from the fusible element 12. When the switch 24 opens and its contacts 26 move apart, current is commutated to the fusible element 12 for interruption thereof.

Surrounding the fusible element 12 and the cylinder 16 is an outer housing 30 made of an insulative material, such as cycloaliphatic epoxy resin. The housing 30 and the cylinder 16 define a volume 32 therebetween which may be filled with fulgurite-forming medium (not shown) such as silica sand or quartz sand. As is well known, the fusible element 12 and the medium co-act to interrupt current in the element 12 in a current-limiting or energy-limiting manner. The entire fuse 10 is mountable and electrically connectable to an electrical circuit (not shown) by end terminals 34 which may protrude beyond the ends of the cylinder 16 and the housing 30. The terminals 34 are electrically connected to both the respective ends 28 of the fusible element 12 and the respective contacts 26 in any convenient manner.

Figure 2:
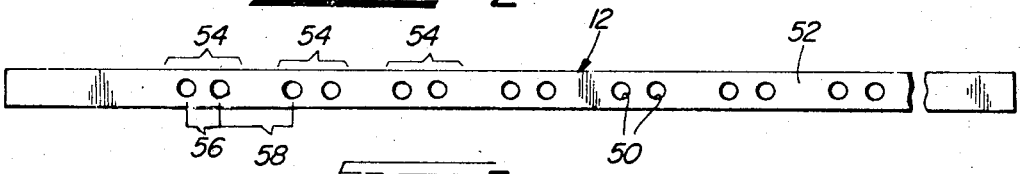
FIGS. 2, 3 and 4 are plan views of alternative embodiments of the fusible element according to the present invention, which elements are usable in the current-limiting fuse of FIG. 1.
Figure 3:
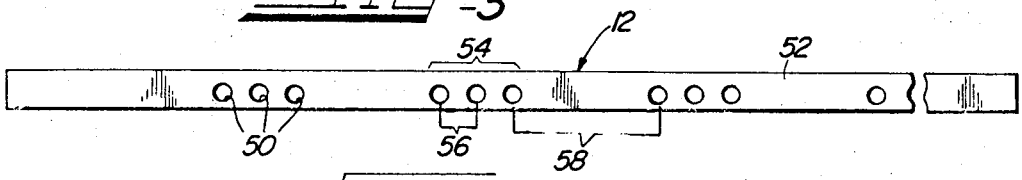
Figure 4:
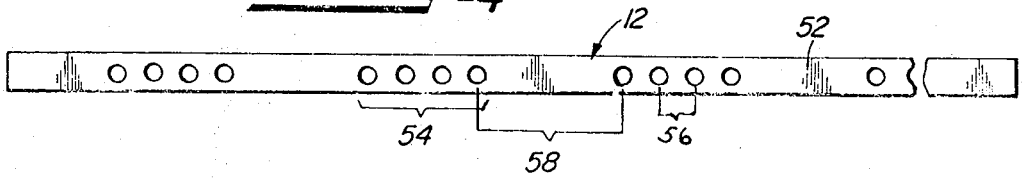

Turning now to FIGS. 2-4, various embodiments of the fusible element 12 are depicted. In each embodiment, a series of holes 50 are formed through the fusible elements 12. The holes 50 are depicted as being circular in cross-section and as being centrally located between the edges of the fusible element 12 along the length thereof. It is to be understood that the holes 50 may have other cross-sections and need not be centered between the edges of the element 12. Further, the holes 50 may be replaced by notches, that is, regions of any cross-section formed through the element 12 at one or both edges thereof. Also, the holes 50 or notches need not extend completely through the element 12.

In preferred embodiments, the element 12 is a copper ribbon, although other metals, such as elemental silver, may be used. The elements 12 illustrated are intended for use in 15 kv circuits in which faults at either 15 kv (phase-to-phase faults) or at 9 kv (phase-to-ground) may occur. Accordingly, the elements 12 are approximately 45 inches long. At other voltages, different lengths of elements 12 may be used, as should be apparent.

Also, as depicted in FIGS. 2–4, the elements 12 are shown in a flat, straight configuration. As described with reference to FIG. 1, it is understood that the elements 12 are preferably intended to be used in the helical, circular configuration, although other configurations are possible. Lastly, it is intended that the elements 12 be intimately surrounded by a fulgurite-forming medium, as noted earlier.

In FIG. 2, the fusible element 12 comprises an elongated ribbon of copper 52 in which the holes 50 have been formed. The holes 50 are associated in serial groups 54, there being two holes 50 in each group 54. The two holes 50 of each group 54 are separated by a distance 56 which is substantially shorter than the distance 58 separating each group 54. In the specific example of FIG. 2, the distance 56 between each hole 50 of each group 54 is about 0.470 inch, while the distance 58 between adjacent groups is about 1.125 inch.

FIG. 3 is similar to FIG. 2 except that the holes 50 are in groups 54 of three holes 50. Each hole 50 within the groups is separated from adjacent holes by a distance 56 of about 0.470 inch, while each group is separated by a distance 58 of about 1.46 inch. FIG. 4 is also similar, except that each group 54 has four holes 50. The holes 50 within the groups 54 are separated by a distance 56 of 0.470 inch, while each group 54 is separated by a distance 58 of about 1.8 inch.

In the examples of FIGS. 2–4, various additional dimensions obtain depending on the current rating of the fuse 10. Fusible elements 12 for current-limiting fuses 10 usually are made of ribbons 52 which are from 4–10 mils thick. In the specific examples, the ribbon is about 8 mils thick. For a 200 ampere rated fuse 10, each ribbon 52 is about 0.220–0.225 inch wide and the diameter of each hole 50 is about 0.131 inch. For a 600 ampere rated fuse 10, each ribbon 52 is about 0.263–0.268 inch wide and the diameter of each hole 50 is about 0.143 inch. All of these dimensions relate to specific preferred embodiments, but may be adjusted as required by electrical factors of the circuit as long as separated groups 54 of two or more holes 50 are used.

In each of the three examples of FIGS. 2–4, the hole density along the entire length of the ribbon 52 is about the same (approximately 1.3 holes per inch), there being fifty-four holes 50 in the ribbons 52 of FIGS. 2 and 3 and fifty-six holes in the ribbon 52 of FIG. 4. Letting the distance 56 equal X and the distance 58 equal Y, if each ribbon 52 is viewed as having groups 54 of N holes (2, 3, or 4) each, adjacent holes 50 within the groups 54 being separated the distance X (0.470 inch), and adjacent groups 54 being separated by the distance Y (1.125 inch, 1.46 inch, or 1.8 inch), the quantity $$[(N-1)(X)+Y]/N$$

will be found to be about equal to a constant. The constant in all the examples presented is about 0.8. Also, the quantity $$X/Y$$

is greater than 1 and is preferably at least 2.4. Specifically, in the example of FIG. 2, the latter quantity is about 2.4, in the example of FIG. 3, it is about 3.1, and in the example of FIG. 4, it is about 3.8.

Figures 5A, 5B, 5C, 5D:
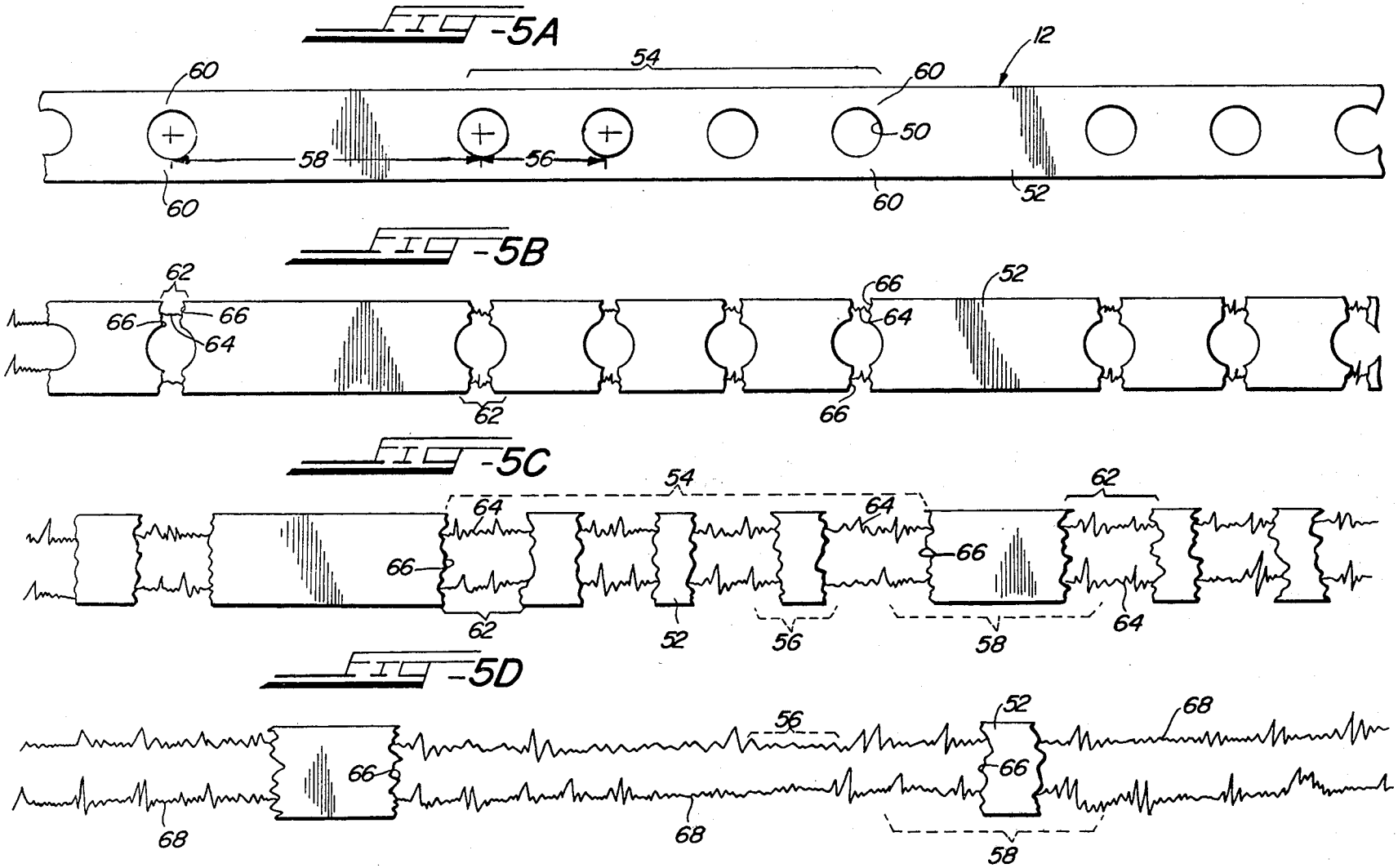
FIGS. 5(A)-5(D) depict the fusible element of FIG. 4 at various times beginning with the inception of a fault current therein at both low and high voltages.

Turning now to FIG. 5, a portion of the ribbon 52 in FIG. 4 is depicted at various times during operation of the fuse 10 in which it is included. Each group 54 has four holes 50, separated by the distance 56 within the groups 54, which groups 54 are separated by the distance 58, as shown in FIG. 5A, while normal current is present. Upon the occurrence of a fault current, portions of the ribbon 52 adjacent the holes 50, generally shown at 60 (FIG. 5A), melt or evaporate to form gaps 62 (FIG. 5B). One or more arcs 64 form in each gap 62 between opposed sites or fronts 66 defining the gaps 62. Each arc 64 develops an arc voltage or back voltage opposing the source driving the fault current. As shown in FIG. 5C, the arcs 64 persist as long as current is in the ribbon 52, and burn back or melt the ribbon 52 to lengthen the gaps 62 and elongate the arcs 64 as the pair of sites or fronts 66 defining each gap 62 recede from each other. Upon formation of the arcs 64, the total arc voltage of the fuse 10 jumps from a small value near zero to a substantial value somewhat less than the voltage of the source driving the fault current. This is due to the establishment of the arcs 62 and the action thereon of the of the fulgurite-forming medium (not shown in FIG. 5) surrounding the ribbon 52. As the arcs 64 burn back the ribbon 52, the arc voltage increases due to the presence of "new" or "fresh" medium adjacent the arcs 64 and to the elongation of the arcs 64. Such new medium is "introduced" to the arcs 64 as the sites 66 of each pair of sites 66 between which each arc 64 forms recede from each other, causing the arcs 64 to interact with medium formerly adjacent only the ribbon 52.

As the arcs 64 elongate and new medium is introduced thereto, the arc voltage or back voltage of the fuse 10 continues to increase. The increasing arc voltage causes the current to turn down and gradually approach zero. The continuing burn-back of the ribbon 52 effects a continuing increase of the arc voltage. Through the time depicted in FIG. 5C, each area of the ribbon 52 formerly containing a group 54 of four holes 50 has four arcs 64 therein. Each arc 64 is formed in a gap 62 defined by a pair of sites 66. As each arc 64 burns back the ribbon 62 and the sites 66 defining it recede from each other, its arc voltage elevates at a rate determined by the rate of burn-back. Thus, each group 54 is responsible for increasing the arc voltage at a rate four times the rate achieved by each individual arc 64. Each group 54 includes eight sites 66 between pairs of which the arcs 64 form.

Referring to FIG. 5D, ultimately the arcs 64 in each group 54 "merge" into a single arc 68 as the ribbon 52 formerly present along the distance 56 between the holes 50 in the groups 54 is consumed by burn-back of the ribbon 52. At this time, each merged arc 68 continues to burn the ribbon 52 back at its two remaining sites 66. It should be noted that the number of sites 66 (two) remaining in FIG. 5D for each arc 68, which now approximately occupies the former location of one of the groups 54 is $\frac{1}{4}$ of the number of original sites 66 (eight) in FIGS. 5B and 5C. If the embodiments of FIGS. 2 or 3 are used, the fraction is, respectively, $\frac{1}{2}$ or $\frac{1}{3}$, that is, 1/N. In FIG. 5D, as the merged arcs 68 continue to burn the ribbon 52 back, the arc voltage increases, albeit at a decreased rate of about $\frac{1}{4}$ (or, more generally, 1/N) the original rate. This is primarily due to the fact that new sand may be introduced to the arcs 68, and the arcs 68 are elongated, as two sites 66 (instead of eight) recede from each other. The portions of the merged arcs 68 remote from the sites 66 are in the vicinity of "old"

medium which does not possess constricting and cooling properties to the same degree as fresh medium.

Thus, during the time the arcs 64 are established, the total arc voltage or back voltage of the fuse 10 increases at a rate determined by the rate of burn-back of the ribbon 52 effected by each arc 64 multiplied by the number of holes 50 in each group 54 multiplied by the number of groups 54. The total arc voltage or back voltage during this period is determined by the amount of burn-back effected by each arc 64 multiplied by the number of holes 50 in each group 54 multiplied by the number of groups 54. After the merged arcs 68 form, the rate of increase of the total arc voltage or back voltage of the fuse 10 is decreased by 1/N, that is, is now determined by the rate of burn-back of the ribbon 52 effected by each arc 68 multiplied by the number of groups 54. The total arc voltage or back voltage during the establishment of the merged arcs 68 is determined by the total amount of burn-back effected by the arcs 66 prior to formation of the merged arcs 68, plus the amount of burn-back effected by each arc 68 multiplied by the number of groups 54.

Assuming the fault current to be driven by a 15 kv source (a phase-to-phase fault), the arc voltage of the fuse 10 exceeds the source voltage shortly after the initial jump in arc voltage caused by establishment of the arcs 64. By selecting a sufficiently long ribbon 52 having a sufficient number of holes 50 and groups 54 therein and a sufficiently long distance 58 between the groups 54, a sufficiently high arc voltage or back voltage will be generated to assure interruption of the higher voltage fault current. Ultimately, at a current zero the arcs 68 are extinguished and the fault current is interrupted. The fact that the arc voltage or back voltage of the fuse 10 may greatly exceed the source voltage during interruption of the phase-to-phase fault is of no great concern. As postulated, each fuse 10 by itself must be capable of interrupting phase-to-phase faults because its operation is initiated by the opening of the shunt switch 24, not by the $I^2t$ effect of the fault current. Moreover, phase-to-ground arrestors do not directly see the arc voltage or back voltage during phase-to-phase faults and as a result will not sparkover as a result thereof.

At the lower voltage phase-to-ground faults, if the arc voltage or back voltage of the fuse 10 so increases as to exceed the sparkover voltage of the arrestors, they will undesirably operate. The merging of the arcs 64 into the arc 68 prevents this occurrence. Specifically, the significant degree of lower voltage fault current turndown achieved by the burn-back of the arcs 66 may be sufficient to interrupt the fault current just before or as the merged arcs 68 are established. The number of holes 50, their distance 56 apart in the groups 54 and the number of groups 54 are selected to achieve or closely approach this result without exceeding the sparkover voltage of the arrestors. If the lower voltage fault current is not interrupted as the merged arcs 68 form, the significant current turndown and the increasing arc voltage or back voltage (albeit at a decreased, 1/N, rate) shortly effect interruption. The decreased rate of increase in the arc voltage or back voltage is selected so that the sparkover voltage of the arrestors is not exceeded.

In effect, then, the location of the holes 50 in the groups 54 permits burn-back of the ribbon 52, elongation of the arcs 64 and 68, and elevation of the arc of back voltage to occur at two different rates. A first or higher rate obtains when the arcs 64 are established. A second or slower rate (1/N times the first rate) obtains when the merged arcs 68 are established. Stated differently, once the merged arcs 68 are established, the rate of introduction of the ribbon 52 to burn-back and the rate of introduction of fresh or new medium to the arcs 68 decreases. The amount of decrease of these rates can be adjusted by appropriate selection of the number of holes 50 in each group 54. Similarly, the first rate may be adjusted by appropriate selection of the number of holes 50 in each group 54, the number of groups 54, and the distance 56; just as the second rate may be adjusted by appropriate selection of the number of groups 54 and the distance 58. The total arc voltage or back voltage which can be generated by the fuse 10 depends on appropriate selection of all of these items and on the length of the ribbon 52. Various permutations and combinations of all pertinent items permit the selection of a ribbon 52 for a fuse 10 which can efficiently interrupt fault currents at two different voltages without exceeding a selected arc voltage or back voltage value.

Various changes may be made in the above-described embodiments of the present invention without departing from the spirit and scope thereof. Such changes as are within the scope of the claims that follow are intended to be covered thereby.

We claim:

1. A fusible element for a high-voltage, current-limiting fuse, comprising:

an elongated, thin, conductive ribbon having along its entire length a substantially uniform thickness and, between its edges, a substantially uniform width, the ribbon having a major longitudinal axis centered between its edges, and a plurality of groups of holes or notches formed through or in the ribbon, the holes or notches having similar transverse locations relative to the axis and to the edges of the ribbon, adjacent holes or notches of each group being separated therewithin along the ribbon by a first distance, measured parallel to the axis, which is substantially less than a second distance, measured parallel to the axis, between adjacent groups along the ribbon, so that both higher and lower voltage fault currents are effectively interrupted, and so that the arc voltage developed by the fuse during the occurrence of the lower voltage fault currents does not exceed a predetermined value.

2. A fusible element as in claim 1 for a high-voltage, current-limiting fuse usable in each phase of a high-voltage polyphase electrical circuit, wherein the higher voltage is a phase-to-phase voltage, and the lower voltage is a phase-to-ground voltage.

3. A fusible element as in claim 2, wherein the higher voltage is about 15 kv, and the lower voltage is about 9 kv.

4. A fusible element as in claim 1, 2 or 3, wherein the ribbon is copper having holes or notches formed therethrough, and the number of holes or notches in each group is 2, 3 or 4.

5. A fusible element as in claim 4, wherein the number of holes is between about 50 and about 60, the number of groups is between about 12 and about 30, and the ribbon is between about 40 inches and about 50 inches long.

6. A fusible element as in claim 4, wherein the first distance is between about 0.400 and about 0.550 inches.

7. A fusible element as in claim 6, wherein the first distance is about 0.470 inch.

8. A fusible element as in claim 4, wherein the second distance is between about 1.10 and about 1.15 inch, between about 1.43 and about 1.49 inch, or between about 1.76 and about 1.84 inch, respectively.

9. A fusible element as in claim 8, wherein the second distance is about 1.125 inch, about 1.46 inch, or about 1.8 inch, respectively.

10. A fusible element as in claim 9, wherein the ribbon is about 45¼ inch long, the first distance is about 0.470 inch, and there are 27 groups of 2 holes each, 18 groups of 3 holes each, or 14 groups of 4 holes each.

11. A fusible element as in claim 1, wherein the number of holes in each group is the same.

12. A fusible element as in claim 1 or 11, wherein following the presence of a fault current at either voltage, the ribbon first melts widthwise at the location of each hole or notch forming a plurality of groups of gaps in the ribbon equal in number to the number of holes or notches with a first arc being established in each gap, following which each first arc burns the ribbon back lengthwise thereof at substantially the same rate lengthening the gaps until the first arcs of each group merge into a second arc, the total number of which second arcs is equal to the number of groups, following which each second arc burns the ribbon back lengthwise thereof, the total rate of burn-back of the ribbon during the establishment of the first arcs is a first rate substantially equal to the rate of burn-back effected by one of the first arcs multiplied by the number of holes or notches, the total rate of burn-back of the ribbon during the establishment of the second arcs is a second decreased rate substantially equal to the rate of burn-back effected by one of the second arcs multiplied by the number of groups, the second decreased rate being no more than about one-half of the first rate, the total amount of burn-back of the ribbon is substantially equal to the product of the first rate multiplied by the amount of time the first arcs have been established, plus the product of the second rate multiplied by the amount of time the second arcs have been established, and the amount of back voltage which may be generated by the fusible element is proportional to the total amount of burn-back of the ribbon, and the rate of increase of the back voltage is proportional to the total rate of burn-back of the ribbon.

13. A current-limiting fuse which includes a fusible element as in claim 12, wherein the number of holes and groups and the first and second distances are selected so that fault currents at both voltages are effectively interrupted, and so that the decreased second rate limits the back voltage generated by the fuse during the interruption of the lower voltage faults currents to a value less than a selected limit.

14. A current-limiting fuse as in claim 13 usable in a polyphase electrical circuit, wherein the higher voltage is a phase-to-phase voltage, the lower voltage is a phase-to-ground voltage, and the selected limit is the spark-over voltage of surge arrestors connected between each phase and ground.

15. A fusible element for a high-voltage, current-limiting fuse, comprising:

a conductive ribbon of uniform width and constant thickness, and a plurality of groups of N holes or notches formed through or in the ribbon, adjacent holes or notches within each group being separated by the same distance X measured along the ribbon, adjacent groups being separated by the same distance Y measured along the ribbon, N being 2 or more and Y/X being at least 2.

16. A fusible element as in claim 15, wherein

Y/X is at least about 2.4; and the quantity $[(N-1)(X)+Y]/N$ is about 0.8.

17. The fusible element of claim 16, for use in a fuse connectable to a 15 kv polyphase circuit, wherein, as approximate values, X=0.470 inch;

N=2, 3 or 4; and

Y=1.25, 1.46 or 1.80 inches, respectively, depending on the value of N.

18. The fusible element of claim 17, wherein the total number of holes or notches in the ribbon is between 50 and 60, and the ribbon is about 45" long.

19. A fusible element as in claim 15, wherein the quantity $[(N-1)(X)+Y]/N$ is a constant.

20. A fusible element as in claim 18, wherein the material of the ribbon is silver or copper.

21. A fuse including the fusible element of claim 15 and usable to protect a polyphase circuit which may experience fault currents at either the higher phase-to-phase voltage of the circuit or the lower phase-to-ground voltage of the circuit, wherein Y is sufficiently larger than X, and X is sufficiently small, so that (a) during the occurrence of fault currents at the lower voltage, the ribbon melts and burns back along the distance X between the holes in each group but does not substantially burn back along the distance Y between the groups until the fault current is interrupted, thereby preventing the production of arc voltages in excess of a selected value, and (b) during the occurrence of fault currents at the higher voltage, the ribbon melts and burns back first along the distance X and then along the distance Y by a significant amount until the fault current is interrupted.

* * * * *